US006889970B2

(12) United States Patent
Takahashi et al.

(10) Patent No.: US 6,889,970 B2
(45) Date of Patent: May 10, 2005

(54) DELIVERY APPARATUS FOR FOLDING MACHINES

(75) Inventors: Yukitoshi Takahashi, Kawasaki (JP); Tomonari Nakajima, Kawasaki (JP); Hiroyuki Fujinuma, Kunitachi (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/667,055

(22) Filed: Sep. 22, 2003

(65) Prior Publication Data

US 2004/0075208 A1 Apr. 22, 2004

(30) Foreign Application Priority Data

Oct. 22, 2002 (JP) ..... 2002/306478

(51) Int. Cl.[7] ..... B41F 13/58

(52) U.S. Cl. ..... 270/6; 270/7; 270/21.1; 393/359; 271/270; 271/315

(58) Field of Search ..... 270/6, 7, 8, 20.1, 270/21.1, 5.02; 271/270, 315; 393/356, 359, 369, 425

(56) References Cited

U.S. PATENT DOCUMENTS 4,159,823 A * 7/1979 Bryer et al. ..... 493/369
4,368,879 A * 1/1983 Hoshi ..... 270/6
4,720,089 A * 1/1988 Richter ..... 270/43
5,080,338 A * 1/1992 Belanger et al. ..... 270/6
5,242,367 A * 9/1993 Marmin ..... 493/359
5,405,126 A * 4/1995 Mack ..... 270/6
5,522,586 A * 6/1996 Bennett et al. ..... 270/8
5,653,428 A * 8/1997 Dufour et al. ..... 270/6
6,199,860 B1 * 3/2001 d'Agrella et al. ..... 271/315
6,244,593 B1 * 6/2001 Schaefer et al. ..... 271/270

FOREIGN PATENT DOCUMENTS

JP 2000-185858 7/2000
JP 2003-165661 6/2003

* cited by examiner

*Primary Examiner*—Eugene H. Eickholt
(74) *Attorney, Agent, or Firm*—McGlew and Tuttle, P.C.

(57) ABSTRACT

A delivery apparatus for folding machines having a folding apparatus FA and a delivery apparatus DA, comprising a delivery fly 3 for receiving signatures S1, S2 and S3 folded by the folding apparatus FA, a conveyor C for operating the delivery fly 3 at a predetermined speed ratio and receiving the signatures S1, S2 and S3 from the delivery fly 3, a gear drive 1 having a plurality of gear ratios provided between the folding apparatus FA and the delivery fly 3 for transmitting power to the delivery fly 3, and changeover means 2 capable of selectively changing over the gear ratio of the gear drive 1, so that the operating speed of the delivery fly 3 can be set to a plurality of speed steps with respect to the operating speed of the folding apparatus FA.

10 Claims, 11 Drawing Sheets

DELIVERY APPARATUS FOR FOLDING MACHINES

BACKGROUND OF THE INVENTION

1. Field of the Invention

The present invention relates generally to a delivery apparatus for folding machines for forming signatures by selectively changing over a straight run for cutting a paper web into cut-length sheets of a predetermined length and sequentially folding the cut-length sheets in a folding apparatus, and a collect run for overlapping two sheets of the cut-length sheets in the folding apparatus and subsequently folding the two overlapped sheets, then placing the formed signatures onto an in-service conveyor via a delivery fly to deliver the signatures in a state where the forward face of the signatures is caused to feather, or to be offset overlapped, and more particularly to a folding machine for allowing signatures to be discharged by making the feathered overlap pitch of the signatures in the straight run the same as the feathered overlap pitch of the signatures in the collect run where the number of signatures to be formed is half, for example, as many as the number of signatures to be formed in the straight run.

2. Description of the Related Art

A conventional type of delivery apparatus for folding machines having the aforementioned construction as disclosed in Japanese Published Unexamined Patent Application No. 2000-185858 is publicly known. The prior-art delivery apparatus for folding machines disclosed in that Patent Application has a variable gear-ratio gear drive provided between a drive gear operating in conjunction with a folding apparatus and a drive shaft of a discharge conveyor, in which the gear ratio of the gear drive is changed in accordance with the changeover from a straight run mode to a collect run mode so as to change only the operating speed of the conveyor with respect to the operating speed of the folding apparatus, that is, so as to make only the operating speed of the conveyor slower with respect to the operating speed of the folding apparatus when changing over to the collect run, so that signatures can be delivered with the feathered overlap pitch of the signatures in the straight run made equal to the feathered overlap pitch of the signatures in the collect run.

Heretofore, signatures formed in the folding apparatus are placed on the conveyor via the delivery fly in such a manner that a succeeding signature is placed on the conveyor after moved at the operating speed of the delivery fly to a position where the succeeding signature overlaps a preceding signature that has been placed on the conveyor offset by a predetermined distance. Consequently, the portion of the succeeding signature that runs off the receiving area of the delivery fly tends to be unwantedly moved while coming in contact with the preceding signature that has been previously placed on the conveyor earlier.

In the prior art disclosed in Japanese Published Unexamined Patent Application No. 2000-185858, the feathered overlap pitch of the signatures in the collect run is made equal to the feathered overlap pitch of the signatures in the straight run by making the operating speed of the conveyor slower while the operating speed of the delivery fly for transferring the signatures received from the folding apparatus to an appropriate position on the conveyor is kept matched with the operating speed of the folding apparatus. This construction could cause the following problem. That is, as the succeeding signature that has been moving at the operating speed of the delivery fly are placed on the conveyor in an uncontrolled state and is now moved while coming in contact with the preceding signature that is moving at the operating speed of the conveyor, the preceding signature is forced to move together with the succeeding signature, causing a large deviation in the feathered overlap pitch. This may result in troubles in handling the signatures with handling means on the downstream side, such as failure to grip the signatures one by one with the grip transfer device.

SUMMARY OF THE INVENTION

It is an object of the present invention to provide a delivery apparatus for folding machines which can change over operating speed ratios of the folding apparatus and the delivery fly by changing over gear ratios of the gear drive via changeover means, so that signatures can be delivered in a state where the feathered overlap pitch of the signatures in the straight run is equal to the feathered overlap pitch of the signatures in the collect run.

It is another object of the present invention to provide a folding apparatus in which signatures can be delivered in a state where the feathered overlap pitch of the signatures in the straight run is equal to the feathered overlap pitch of the signatures in the collect run.

It is a further object of the present invention to provide a gear drive that can change over from the straight run to the collect run.

It is still a further object of the present invention to provide positive-motion changeover means having a simple construction and capable of easily changing over gear ratios of the gear drive.

It is still a further object of the present invention to provide a conveyor that is caused to rotate at a predetermined speed ratio with respect to the delivery fly at any time.

It is still a further object of the present invention to provide a delivery fly for receiving and discharging signatures that have been folded in the folding apparatus to the conveyor.

In the disclosed embodiment, the delivery apparatus for folding machines having a folding apparatus and a delivery apparatus comprises a delivery fly for receiving signatures that have been folded in the folding apparatus, a conveyor operating at a predetermined speed ratio with respect to the delivery fly for receiving the signatures from the delivery fly, a gear drive having a plurality of gear ratios and provided between the folding apparatus and the delivery fly for transmitting power to the delivery fly, changeover means capable of selectively changing over gear ratios of the gear drive, so that the operating speed of the delivery fly can be set to a plurality of stages with respect to the operating speed of the folding apparatus.

DETAILED DESCRIPTION OF THE PREFERRED EMBODIMENTS

Now, embodiments of the present invention will be described, referring to the accompanying drawings.

Figure 1:
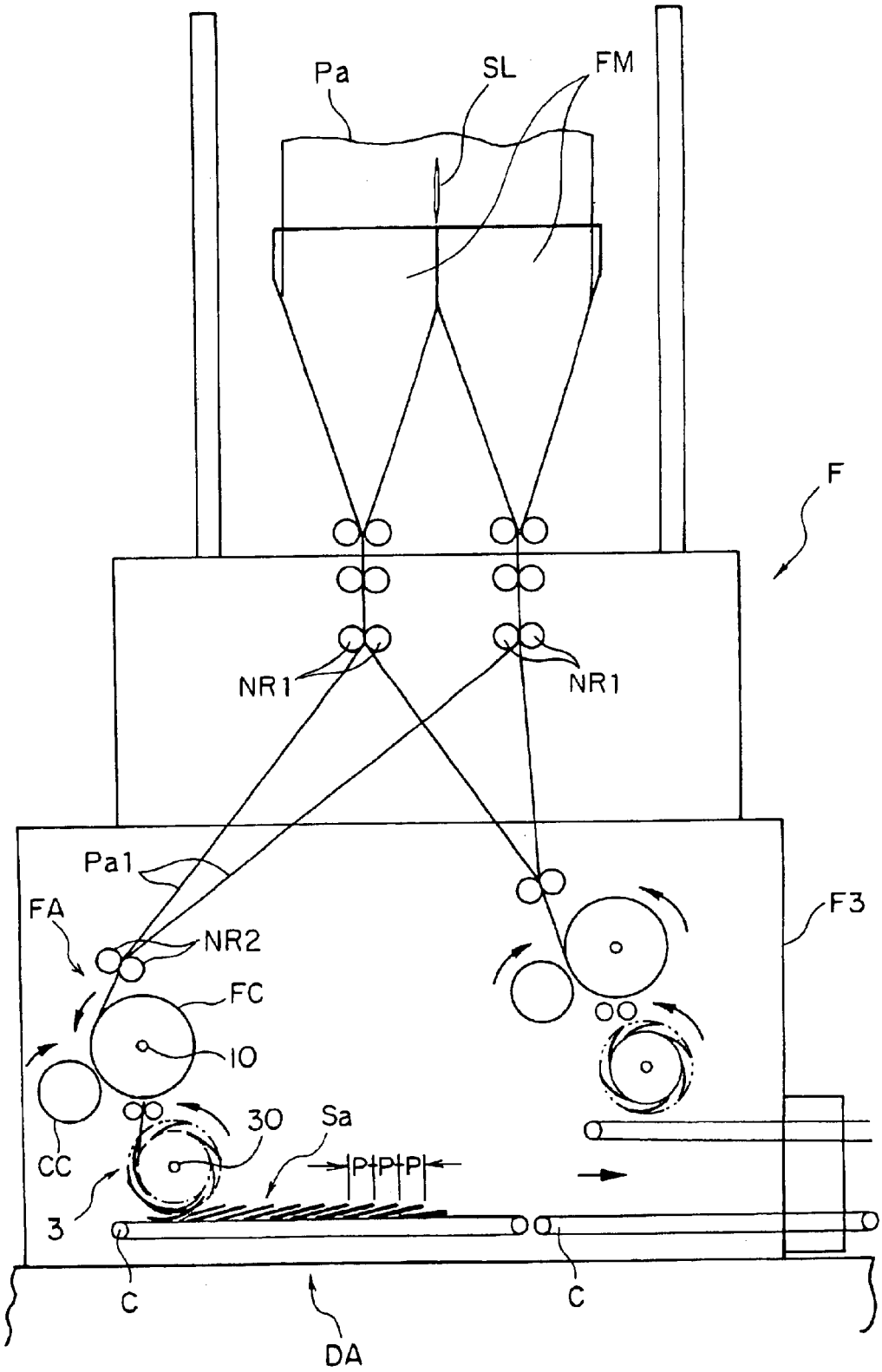
FIG. 1 is a partially cross-sectional development illustrating the construction of an embodiment of the gear drive and the changeover means of the delivery apparatus according to the present invention.
Figure 2:
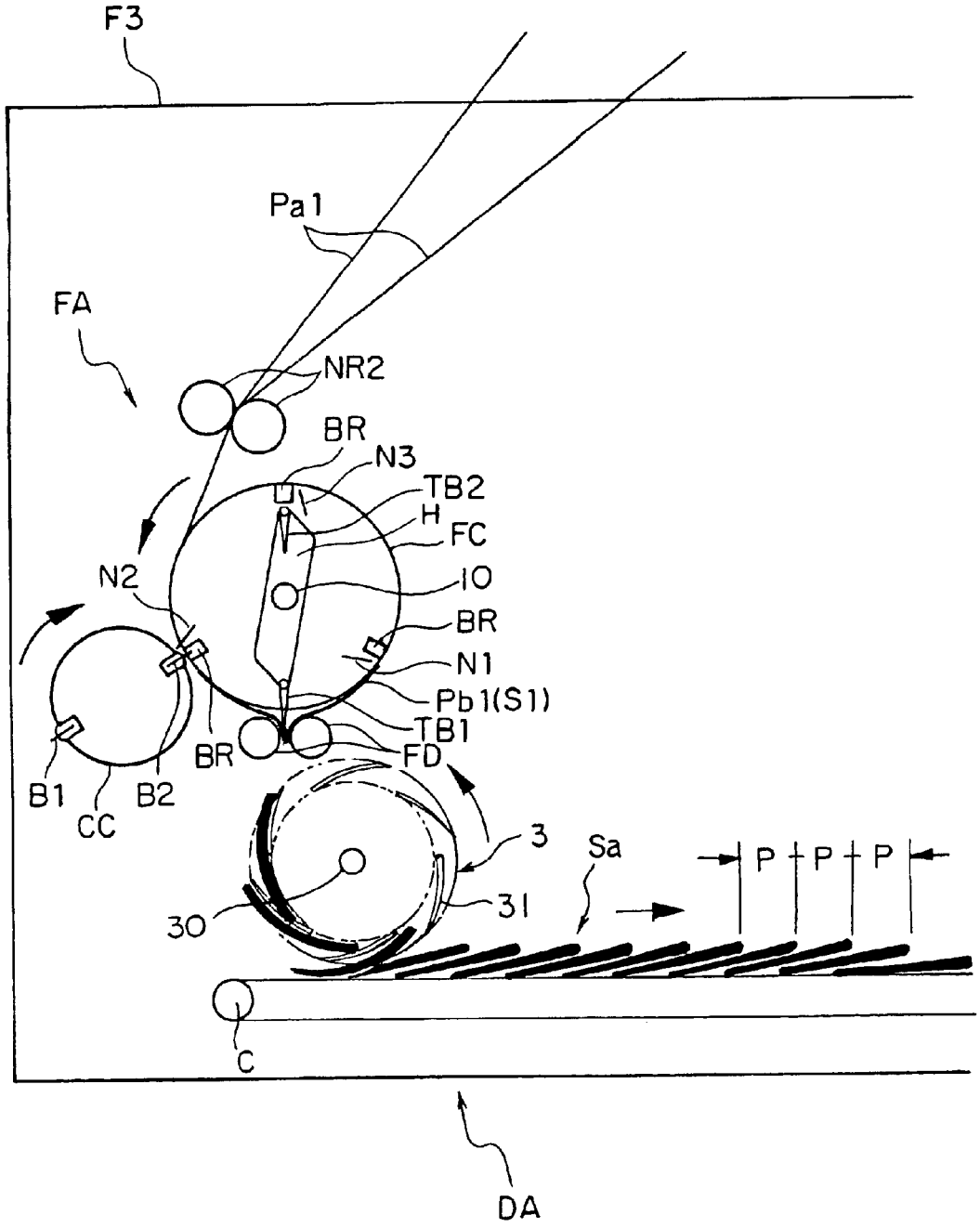
FIG. 2 is a view taken in the direction of an arrow A of the changeover means in the embodiment shown in FIG. 1.

In FIGS. 1 and 2, a folding machine F comprises a former F, a folding apparatus FA, and a delivery apparatus DA. The folding apparatus FA has two folding rollers FD and FD provided facing a cutting cylinder CC and a folding cylinder FC. The cutting cylinder CC has two cutting blades B1 and B2 provided at equal intervals on the outer circumferential surface of the cutting cylinder CC, whereas the folding cylinder FC has three cutting blade rests BR, BR and BR provided at equal intervals on the outer circumferential surface of the folding cylinder FC, three pins N1, N2 and N3 provided in such a manner as to be protruded from or retracted below the outer circumferential surface of the folding cylinder FC on the upstream side in the rotational direction of the folding cylinder FC in the vicinity of the cutting blade rests BR, BR and BR, and two tucker blades TB1 and TB2 supported by a tucker-blade support member H that makes a half-turn at every ⅓-turn, for example, of the folding cylinder FC. The tucker-blade support member H is provided coaxially on a cylinder shaft 10 of the folding cylinder FC in such a manner that the tucker blades TB1 and TB2 are protruded from the outer circumferential surface of the fold cylinder FC and inserted in between the folding rollers FD and FD. The circumferential length ratio between the cutting cylinder CC and the folding cylinder FC is 2:3.

The delivery apparatus DA has a delivery fly 3, a discharge conveyor C, a gear drive 1 having a plurality of gear ratios, which will be described later with reference to FIGS. 3 and 4, for transmitting power from the folding apparatus FA to the delivery fly 3, and changeover means 2 that can selectively change over the gear ratios of the gear drive 1.

Figure 3:
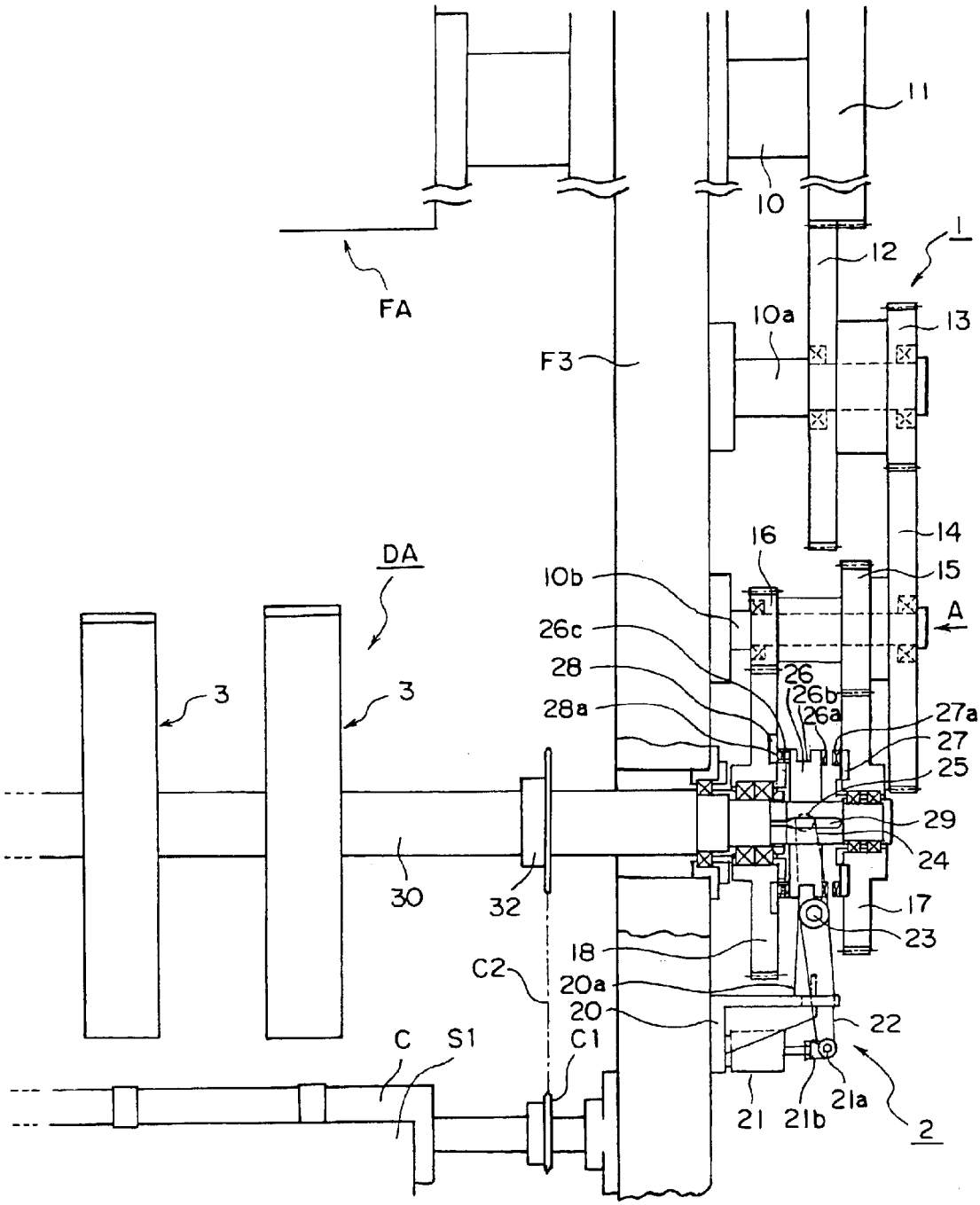
FIG. 3 is a schematic block diagram showing an outline of a folding machine to which the present invention can be applied.
Figure 4:
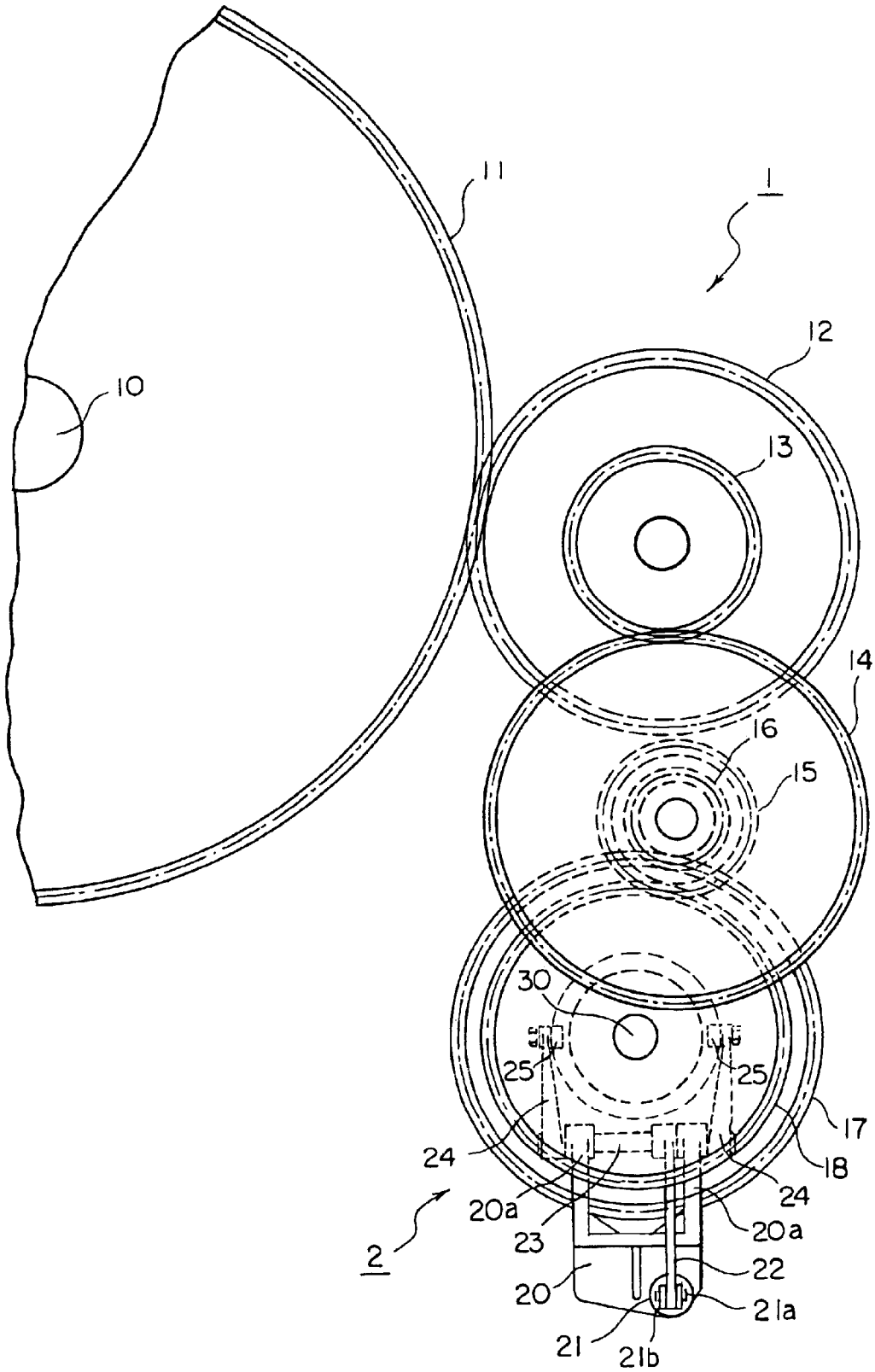
FIG. 4 is an enlarged diagram of assistance in explaining major parts of the folding apparatus and the delivery apparatus shown in FIG. 3.
Figure 5:
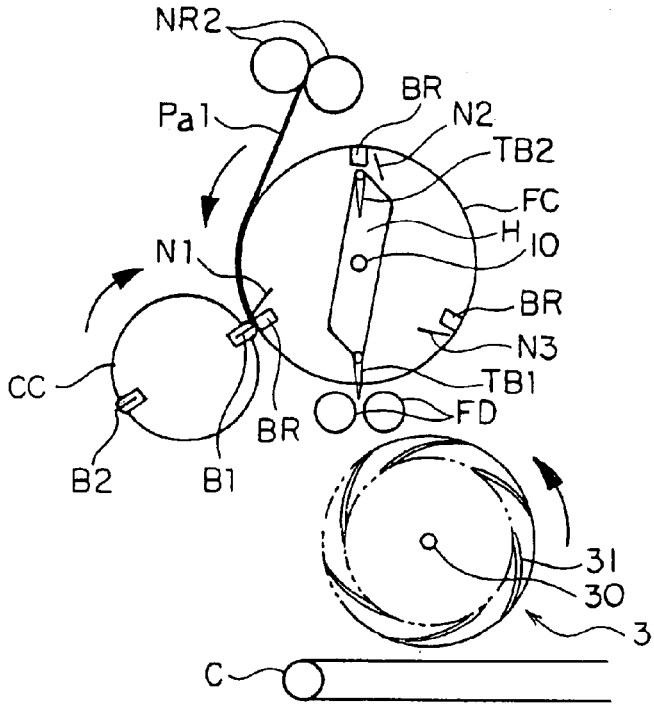
FIG. 5 is a diagram of assistance in explaining the operation of the present invention in the straight run.
Figure 6:
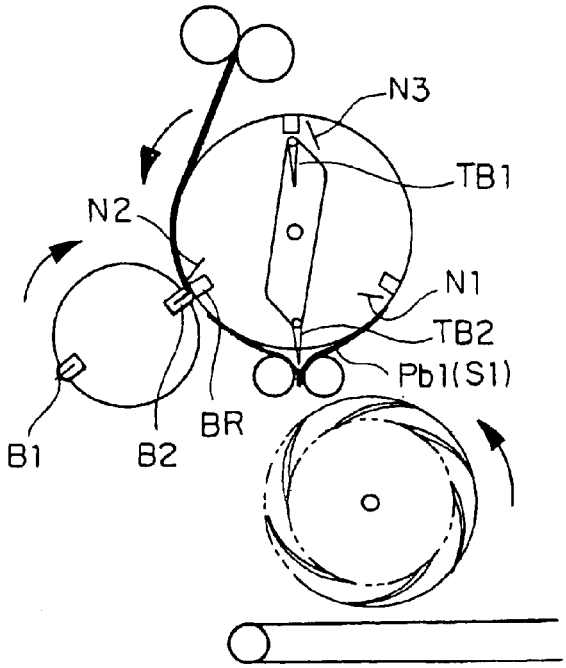
FIG. 6 is a diagram of assistance in explaining the operation of the present invention in the straight run, continued from FIG. 5.
Figure 7:
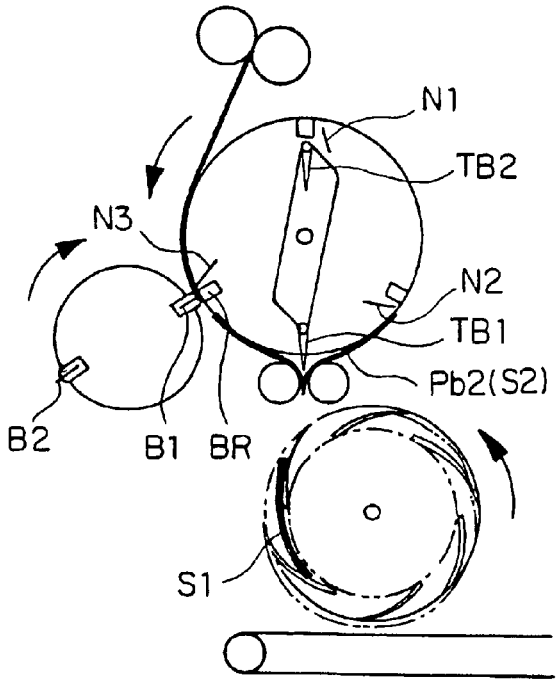
FIG. 7 is a diagram of assistance in explaining the operation of the present invention in the straight run, continued from FIG. 6.
Figure 8:
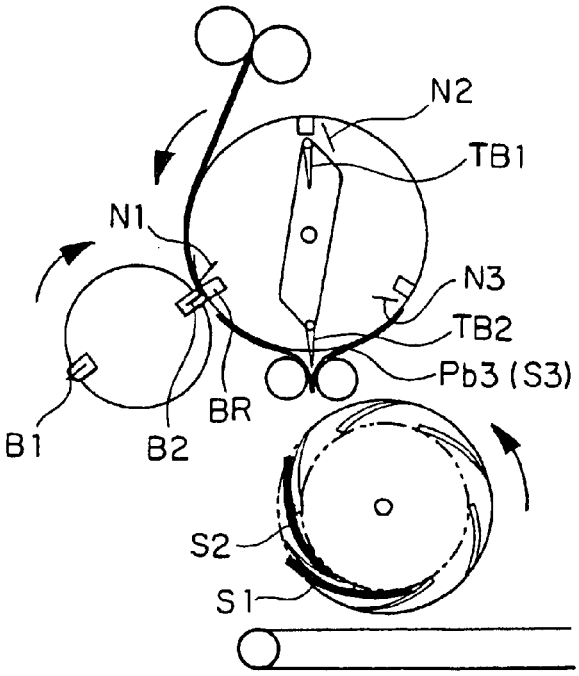
FIG. 8 is a diagram of assistance in explaining the operation of the present invention in the straight run, continued from FIG. 7.
Figure 9:
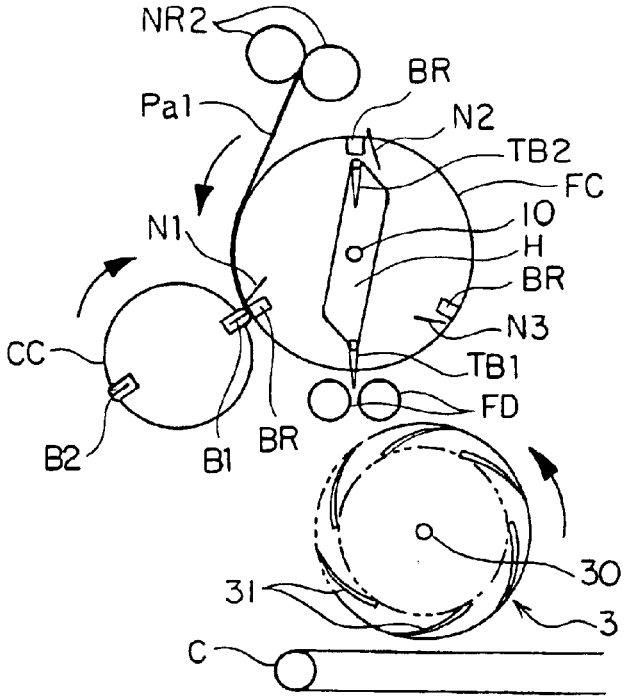
FIG. 9 is a diagram of assistance in explaining the operation of the present invention in the collect run.
Figure 10:
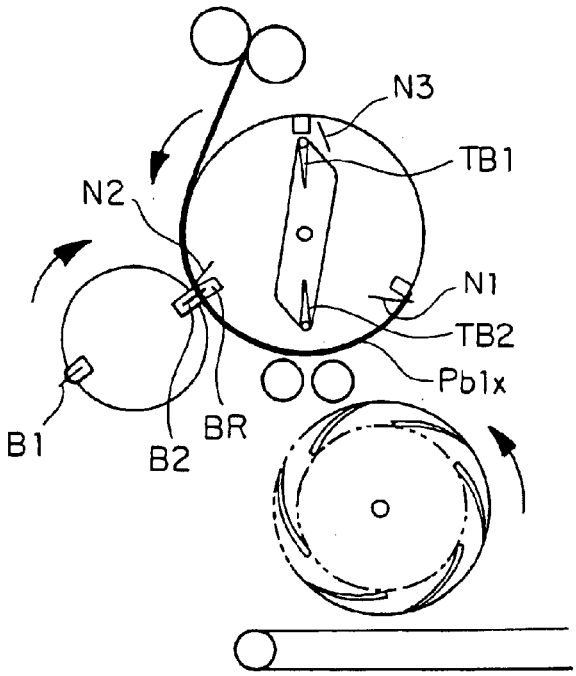
FIG. 10 is a diagram of assistance in explaining the operation of the present invention in the collect run, continued from FIG. 9.
Figure 11:
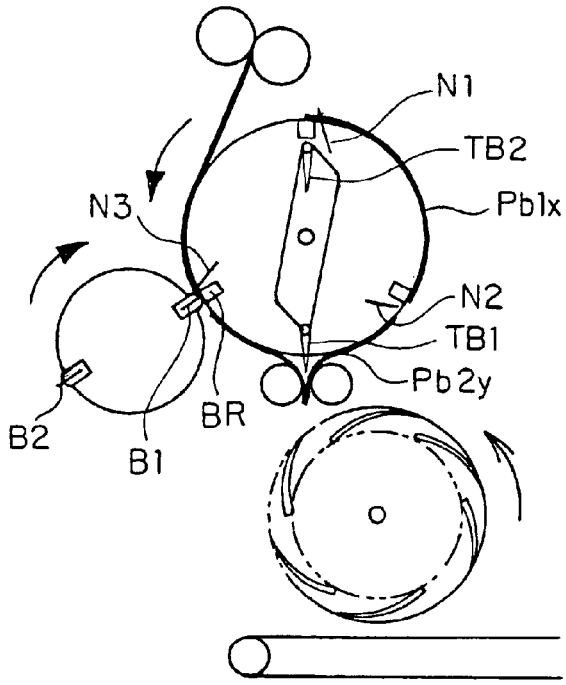
FIG. 11 is a diagram of assistance in explaining the operation of the present invention in the collect run, continued from FIG. 10.
Figure 12:
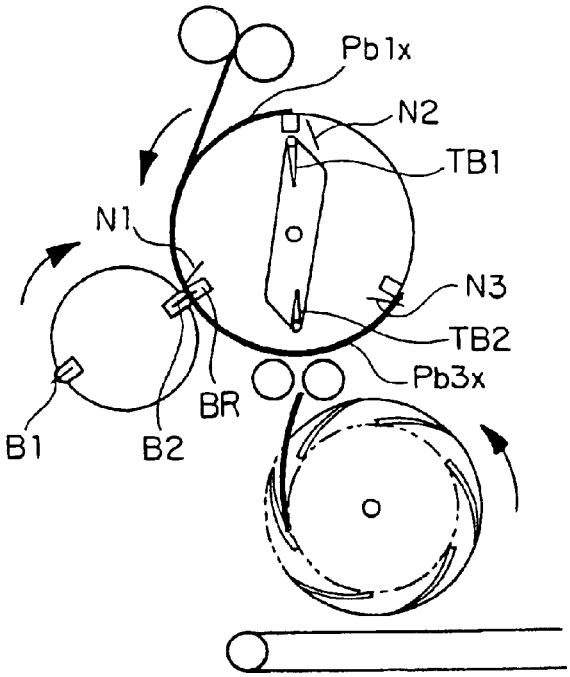
FIG. 12 is a diagram of assistance in explaining the operation of the present invention in the collect run, continued from FIG. 11.
Figure 13A:
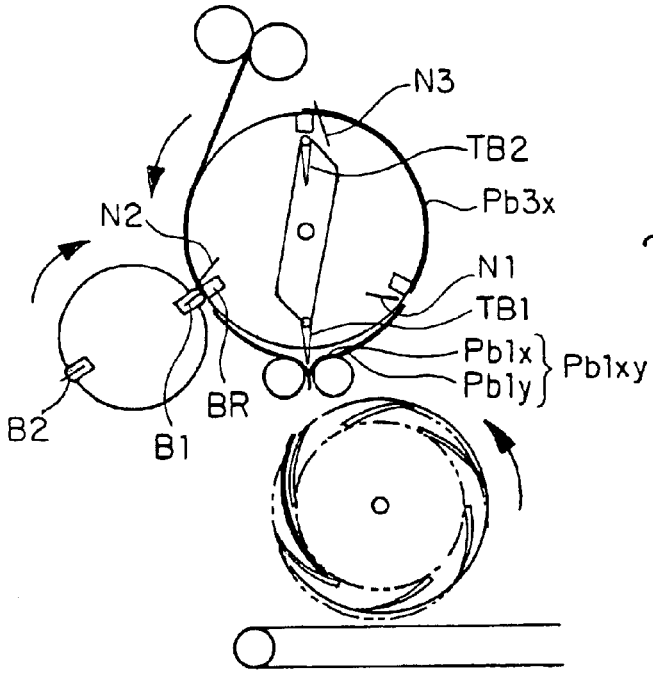
FIG. 13 is a diagram of assistance in explaining the operation of the present invention in the collect run, continued from FIG. 12.
Figure 13B:
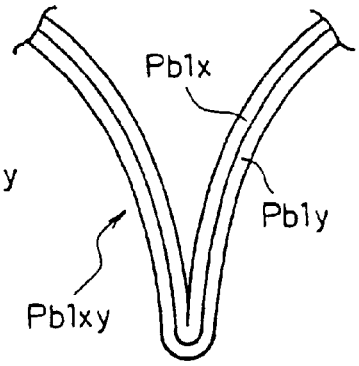

The gear drive 1 and the changeover means 2 have such a construction as shown in FIGS. 3 and 4.

That is, the gear drive 1 comprises a gear 11 provided on an end of the cylinder shaft 10 of the folding cylinder FC on the side protruding toward the outer surface of a frame F3, in such a manner as to be rotatable as the folding apparatus FA is driven, a gear 12 provided rotatably with respect to a first intermediate shaft 10*a* and engaged with the gear 11, a gear 13 provided rotatably and integrally with the gear 12 with respect to the first intermediate shaft 10*a*, a gear 14 provided rotatably with respect to the first intermediate shaft 10*a* and engaged with the gear 13, gears 15 and 16 provided rotatably and integrally with respect to a second intermediate shaft 10*b* and also rotatably and integrally with each other, a gear 17 provided on an end of the delivery fly shaft 30 of the delivery fly 3 on the side protruding toward the outer surface of the frame F3, in such a manner as to be rotatable with respect to a delivery fly shaft 30, and engaged with the gear 15, and a gear 18 provided rotatably with respect to the delivery fly shaft 30 between the gear 17 and the frame F3 on the delivery fly shaft 30 on the side protruding toward the outer surface of the frame F3; the gear ratio being set so that the number of rotation transmitted to the gear 18 via the gear 16 equals to half of the number of rotation transmitted to the gear 17 via the gear 15.

The changeover means 2 comprises a changeover clutch provided on the delivery fly shaft 30 between the gear 17 and the gear 18. On the mutually facing side surfaces of the gear 17 and the gear 18 rotatably provided are a tooth clutch 27 and a tooth clutch 28, with a clutch tooth 27*a* and a clutch tooth 28*a* facing each other in such a manner as to be rotatable integrally with the gear 17 or 18, and a double-sided tooth clutch 26 having a clutch tooth 26*a* on a surface facing the tooth clutch 27 and a clutch tooth 26*c* on a surface facing the tooth clutch 28 is provided on the delivery fly shaft 30 between the tooth clutch 27 and the tooth clutch 28 in such a manner as to be constrained in the direction of rotation with respect to the delivery fly shaft 30 and axially movable via a sliding key 29. The gap between the clutch tooth 27*a* of the tooth clutch 27 and the clutch tooth 28*a* of the tooth clutch 28 is larger in size than the distance from the tip of the clutch tooth 26*a* of the double-sided tooth clutch 26 to the tip of the clutch tooth 26*c*, and is such that when any of the clutch tooth 26*a* or 26*c* is fully in mesh with the facing clutch tooth 27*a* or 28*a*, the tooth top of the counterpart clutch tooth 26*a* or 26*c* has a gap with the tooth top of the facing clutch tooth 27*a* or 28*a*.

A roller groove 26*b* is provided on the outer circumferential surface at the axially intermediate part of the double-sided tooth clutch 26. A shaft 23 that is angularly movable with respect to bifurcated bearings 20*a* and 20*a* that rise on a free end of an L-shaped bracket 20 provided on the frame F3 is provided on the bifurcated bearings 20*a* and 20*a* in a right-angle and twisted positional relations with the delivery fly shaft 30. An end of an arm 22 is mounted on the intermediate part of the shaft 23, and shifter arms 24 and 24 are on both ends thereof, both integrally with the shaft 23 and in such a manner as to make an angular movement. The other end of the arm 22 is connected via a knuckle 21*b* and a pin 21*a* to an output rod of a changeover actuator 21, which is a pneumatic cylinder, for example, mounted on the frame F3 in an appropriate manner. On the other ends each of the shifter arms 24 and 24 rotatably provided is a roller 25 that is disposed in the aforementioned roller groove 26*b* provided on the double-sided tooth clutch 26. The telescopic movement of the output rod of the changeover actuator 21 causes the double-sided tooth clutch 26 to reciprocate in the axial direction of the delivery fly shaft 30. This reciprocating movement simultaneously accomplishes engagements of the clutch tooth 26*a* and the clutch tooth 27*a*, and of the clutch tooth 26*c* and the clutch tooth 28*a* at the intermediate position of the reciprocating movement. As a result, no changes are brought about in the phase relationship between the folding cylinder FC and the delivery fly 3 in drive shifting via the changeover means 2 despite the unconstrained rotation of the gear 17 and the gear 18 with respect to the delivery fly shaft 30. S1 is a signature. Pinss to say, shifting of the drive power via the changeover means 2 is accomplished while the folding machine F is stopped.

The discharge conveyor C is driven by the power transmitted by a delivery fly sprocket 32 provided on the delivery fly shaft 30, a conveyor sprocket C1 provided on an appropriate rotating shaft of the conveyor C, and an endless chain C2 connecting the sprocket 32 and the conveyor sprocket C1, and caused to rotate at a predetermined speed rate together with the delivery fly 3 at all times.

In the embodiment described above, particularly with reference to FIGS. 1 and 2, the paper web Pa is slit into half at the across-the-width center thereof in the direction parallel to the travel direction by a slitter SL immediately before a former FM. Each of the slit pieces is folded in the former FM into a longitudinally folded paper web Pa1. The longitudinally folded paper web Pa1 is passed through a nipping roller NR1 immediately downstream of the former FM and a nipping roller NR2 upstream of the folding apparatus FA, and guided in between the cutting cylinder CC and the folding cylinder FC, both provided in parallel adjacent with each other and rotating in opposite directions. The cutting cylinder CC and the folding cylinder FC of the folding apparatus FA are such that the folding cylinder FC makes a ⅓ rotation at every ½ rotation of the cutting cylinder CC to cut to a predetermined length the longitudinally folded paper web Pa1 guided in between the cutting cylinder CC and the folding cylinder FC through collaborating action caused as a cutting blade B1 or B2 of the cutting cylinder CC bites into a blade rest BR of the folding cylinder FC, producing cut-length sheets Pb1, Pb2 and Pb3. Before the longitudinally folded paper web Pa1 is cut by the cutting blade B1 or B2 of the cutting cylinder CC and the blade rest BR of the folding cylinder FC, the pins N1, N2 and N3 located on the upstream side in the rotational direction in the vicinity of the blade rest BR of the folding cylinder FC stick the longitudinally folded paper web Pa1 on the upstream side in the vicinity of the cut-off position to hold the area near the cut-off position of the longitudinally folded paper web Pa1 on the outer circumferential surface of the folding cylinder FC.

When operating the folding machine F in the straight run mode, the folding machine F is set while not in motion, so that both the tucker blades TB1 and TB2 of the folding cylinder FC can be protruded from the outer circumferential surface of the folding cylinder during the operation of the folding machine F, and the output rod of the changeover actuator 21 of the changeover means 2 described in FIGS. 3 and 4 is retracted to shift the double-sided tooth clutch 26 to the side of the gear 17, so that the gear drive 1 is changed over to a state where the clutch tooth 26*a* is in mesh with the clutch tooth 27*a*. The folding machine F is put into operation in the aforementioned state.

As shown in FIGS. 5 through 8, the pins N1, N2 and N3 sequentially stick the longitudinally folded paper web Pa1 on the upstream side in the vicinity of the cut-off position in the vicinity of the position where the folding cylinder FC and the cutting cylinder CC come very close to and face each other, then the cutting blades B1 and B2 of the cutting cylinder CC sequentially bite into the blade rest BR of the folding cylinder FC at the position where the folding cylinder FC and the cutting cylinder CC come very close to and face each other to cut the longitudinally folded paper web Pa1 at the cut-off position, sequentially producing the cut-length sheets Pb1, Pb2 and Pb3 on the downstream side in the rotational direction. The pins N1, N2 and N3 retract into the folding cylinder FC at every one rotation at a position where the folding cylinder FC goes ahead of the cutting cylinder CC by one-third in the rotational direction of the folding cylinder FC from the position where the folding cylinder FC and the cutting cylinder CC come very close and face each other, sequentially releasing the cut-length sheets Pb1, Pb2 and Pb3 that have been held thereby. Simultaneously with the sequential release of the cut-length sheets Pb1, Pb2 and Pb3 by the pins N1, N2 and N3, the tucker blades TB1 and TB2 protrude from the outer circumferential surface of the folding cylinder FC, sequentially pushing the intermediate parts of the cut-length sheets Pb1, Pb2 and Pb3 that adhere to the outer surface of the folding cylinder FC in between the folding rollers FD and FD provided in parallel with each other in the vicinity of the downstream side of the folding cylinder FC. The folding rollers FD and FD nip the intermediate part of the cut-length sheets Pb1, Pb2 and Pb3 forced therebetween to produce creases, and release the cut-length sheets Pb1, Pb2 and Pb3 as signatures S1, S2 and S3, with the creases taking the lead, toward the delivery fly 3 provided on the downstream side of the folding rollers FD and FD.

The delivery fly 3 is such that a plurality of (four, for example) small-diameter discs having a plurality of (six in the figure) blades 31 almost tangentially extending outward from equally spaced outer circumferential positions are mounted at appropriate intervals in the axial direction of the delivery fly 3 with the phases of blades 31 matched with each other, and that the delivery fly is caused to rotate (by a factor of the number of blades installed at every ⅓ turn of the folding cylinder) so that the signature receiving areas between the adjoining blades 31 and 31 on the circumferential surface of the delivery fly 3 sequentially come facing the intermediate area between the folding rollers FD and FD every time the folding rollers FD and FD release the signatures S1, S2 and S3 as a result of the changeover of drive power by the changeover means 2, and the adjoining signature receiving areas on the circumferential surface of the delivery fly 3 sequentially receive the signatures S1, S2 and S3 released by the folding rollers FD and FD.

The delivery fly 3 that sequentially receive the signatures S1, S2 and S3 on the signature receiving areas thereof continues rotation, pushes the signatures S1, S2 and S3 out of the signature receiving areas via stoppers (not shown) provided at appropriate positions between the small-diameter discs having the blades 31, - - - . The signatures S1, S2 and S3 pushed out of the signature receiving areas of the delivery fly 3 are then received on the transfer surface of the discharge conveyor C provided below the delivery fly 3, discharged to the outside of the folding machine F in the form of a signature train Sa (see FIGS. 1 and 2) which is formed by the signatures shifted by a predetermined overlap pitch P determined taking into account the rotational speed of the delivery fly 3 and the transfer speed of the conveyor C, and handled by a device on the downstream side, such as a grab transfer device that grabs for transfer the signatures S1, S2 and S3 one by one.

Next, when operating the folding machine F in the collect run mode, the folding machine F, which is not in motion, is set by any appropriate means, so that any one of the tucker blades TB1 and TB2 of the folding cylinder FC can protrude from the outer circumferential surface while the machine is in motion, the double-sided tooth clutch 26 is shifted to the side of the gear 18 by extending the output rod of the changeover actuator 21 of the changeover means 2, so that the gear drive 1 is changed over to a state where the clutch tooth 26*c* is in mesh with the clutch tooth 28*a*. Suppose here that the paper web Pa that runs to the folding machine F contains alternately arranged printed images x and y of different sizes that can match with the sizes of the cut-length sheets Pb1, Pb2 and Pb3. Now, the folding machine F can be operated in the aforementioned state.

Figure 14A:
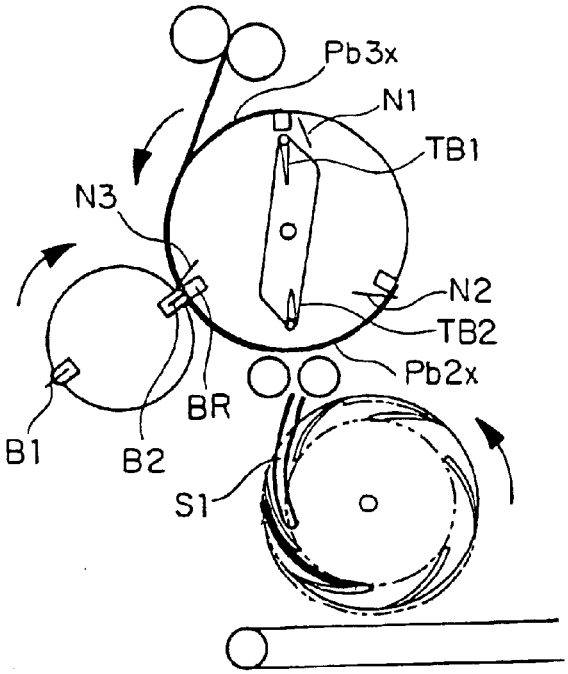
FIG. 14 is a diagram of assistance in explaining the operation of the present invention in the collect run, continued from FIG. 13.
Figure 14B:
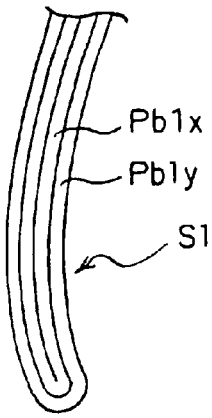
Figure 15A:
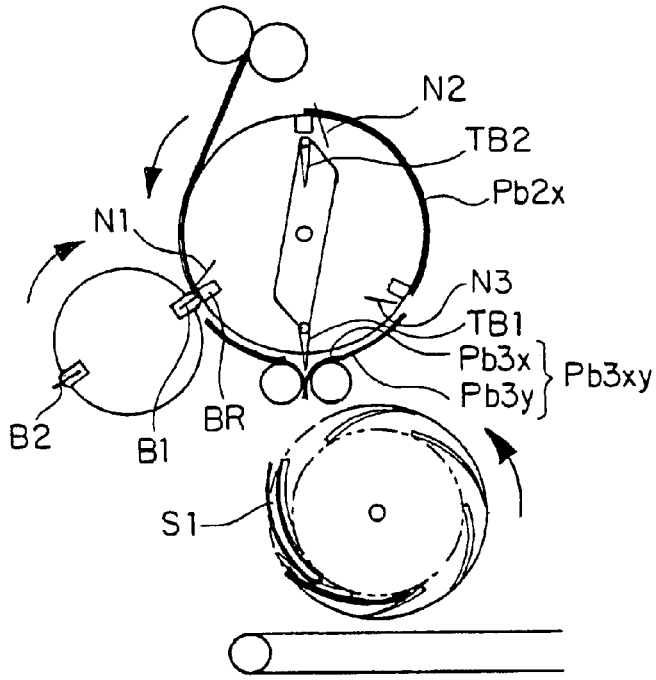
FIG. 15 is a diagram of assistance in explaining the operation of the present invention in the collect run, continued from FIG. 14.
Figure 15B:
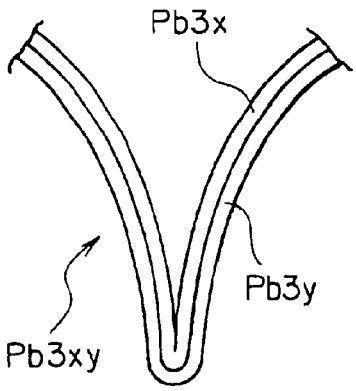
Figure 16A:
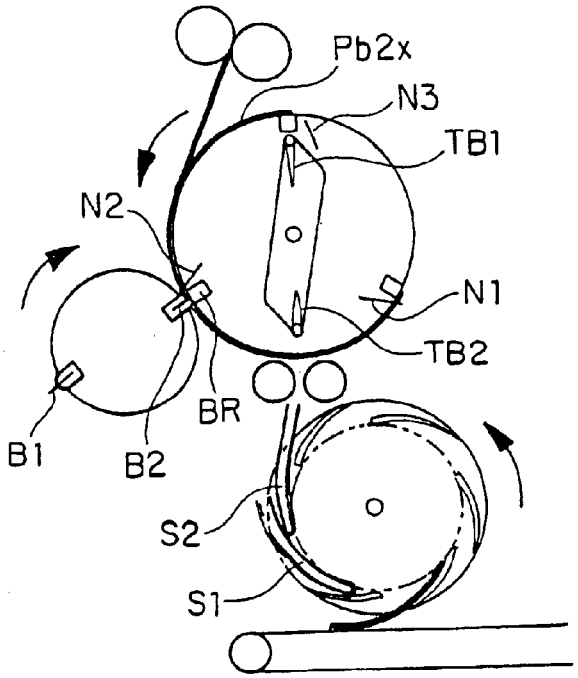
FIG. 16 is a diagram of assistance in explaining the operation of the present invention in the collect run, continued from FIG. 15.
Figure 16B:
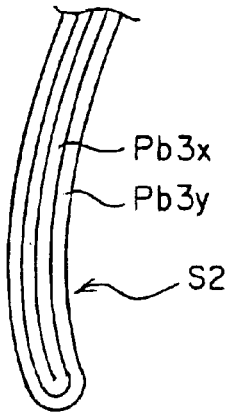
Figure 17A:
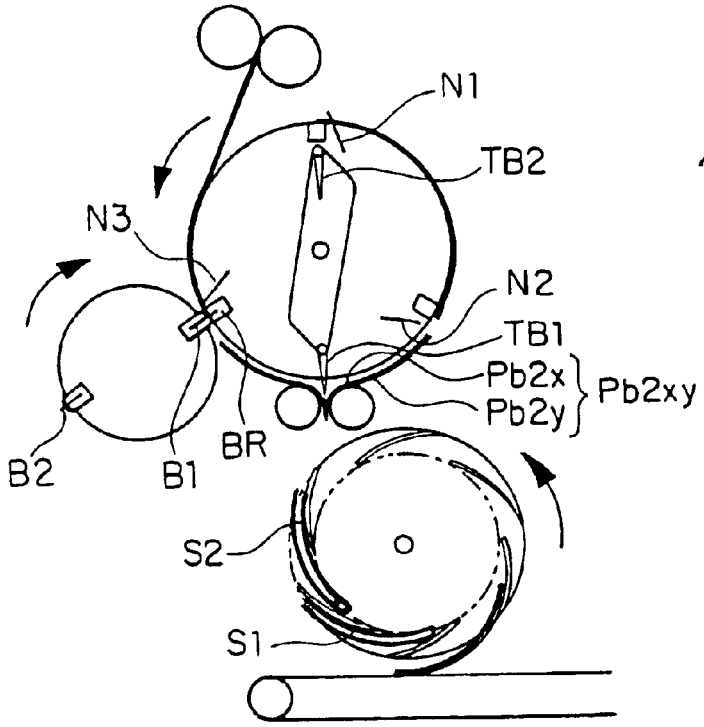
FIG. 17 is a diagram of assistance in explaining the operation of the present invention in the collect run, continued from FIG. 16.
Figure 17B:
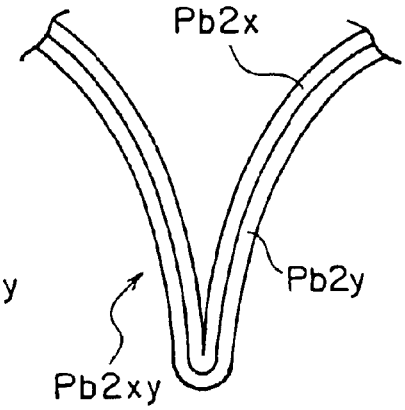

As shown in FIGS. 9 through 17, the pins N1, N2 and N3 sequentially stick the longitudinally folded paper web Pa1 at the upstream side near the cutting position as the pins N1, N2 and N3 approach to the position where the cutting cylinder CC comes very close to and faces the folding cylinder FC. The cutting blades B1 and B2 of the cutting cylinder CC then sequentially bite into the blade rest BR of the folding cylinder FC to cut the longitudinally folded paper web Pa1 at the cutting position, sequentially producing cut-length sheets Pb1*x*, Pb2*y*, Pb3*x*, Pb1*y*, Pb2*x*, and Pb3*y* on the downstream side in the rotational direction. At a position ⅓-rotation ahead in the rotational direction of the folding cylinder FC from the position where the cutting cylinder CC comes very close to and faces the folding cylinder FC, the pins N1, N2 and N3 retract into the folding cylinder FC at every two rotations. Consequently, the pins N1, N2 and N3 are such that the pin N1 holds the cut-length sheets Pb1*x* and Pb1*y* in overlapped state on the outer circumferential surface of the folding cylinder FC, the pin N2 holds the cut-length sheets Pb2*x* and Pb2*y* in overlapped state on the outer circumferential surface of the folding cylinder FC, and the pin N3 holds the cut-length sheets Pb3*x* and Pb3*y* in overlapped state on the outer circumferential surface of the folding cylinder FC. The pins N1, N2 and N3 then sequentially release cut-length sheets Pb1*xy*, Pb2*xy* and Pb3*xy* that have been held in two-fold state. Consequently, any of the pin N1, N2 and N3 that advances to a position ⅓-rotation ahead in the rotational direction of the folding cylinder FC from the position where the cutting cylinder CC comes very close to and faces the folding cylinder FC retracts into the folding cylinder FC in the order of N1, N2 and N3, for example at every ⅔-rotation of the folding cylinder FC, with the result that the cut-length sheets Pb1*xy*, Pb3*xy* and Pb2*xy* held by the pins N1, N2 and N3 are released in the order described above. Simultaneously with the release of the two-fold cut-length sheets Pb1*xy*, Pb3*xy* and Pb3*xy*, any one, TB1, for example, of the tucker blades TB1 and TB2 protrudes from the outer circumferential surface of the folding cylinder FC to sequentially tuck the two-fold Pb1*xy*, Pb3*xy* and Pb2*xy* at the intermediate part thereof in the rotational direction of the folding cylinder FC in between the folding rollers FD and FD provided in the vicinity and in parallel with the downstream side of the folding cylinder FC (see FIG. 13(B), a partially enlarged diagram of Pb1*xy*, FIG. 15(B), a partially enlarged diagram of Pb3*xy*, and FIG. 17(B), a partially enlarged diagram of Pb2*xy*). The folding rollers FD and FD nip the intermediate parts of the cut-length sheets Pb1*xy*, Pb3*xy* and Pb2*xy* inserted therebetween to form creases and release as the signatures S1, S2 and S3, while causing the creases to lead the way, towards the delivery fly 3 provided on the downstream side of the folding rollers FD and FD (the signatures S1 and S2 are such as shown in FIG. 14 (B) which is a partially enlarged view of S1 and FIG. 16(B) which is a partially enlarged view of S2). Consequently, the release of the signatures S1, S2 and S3 by the folding rollers FD and FD in the collect run amounts to half as much as the release of the signatures S1, S2 and S3 by the folding rollers FD and FD in the straight run.

The delivery fly 3 having the same construction as that described with reference to the straight run is such that the rotational speed ratio with respect to the rotational speed of the folding cylinder FC is changed over to half of the rotational speed ratio in the case of the straight run through drive power changeover by the changeover means 2 for changing over the gear drive 1 to a state where the clutch tooth 26*c* is in mesh with the clutch tooth 28*a*, is caused to rotate so that the signature receiving areas between the adjoining blades 31 and 31 on the circumferential positions of the delivery fly 3 sequentially come facing the intermediate area between the folding rollers FD and FD every time the folding rollers FD and FD release the signatures S1, S2 and S3 (that is, caused to rotate by a fraction of the number of blades 31 installed at every ⅔ rotation of the folding cylinder FC), and sequentially receive the signatures S1, S2, S3, - - - released by the folding rollers FD and FD.

The delivery fly 3 that sequentially receive the signatures S1, S2 and S3 on the signature receiving areas thereof continues rotation, pushes the signatures out of the signature receiving areas via stoppers (not shown) provided at appropriate positions between the small-diameter discs having the blades 31, - - - . The signatures S1, S2 and S3 pushed out of the signature receiving areas of the delivery fly 3 are then received on the transfer surface of the discharge conveyor C provided below the delivery fly 3, forming a signature train Sa (see FIGS. 1 and 2) which is formed by the signatures shifted by a predetermined feathered overlap pitch P determined taking into account the rotational speed of the delivery fly 3 and the transfer speed of the conveyor C. In this case, no significant variations are caused in the feathered overlap pitch P because the preceding signature is hardly moved appreciably along with the succeeding signature even when the succeeding signature comes in contact with the preceding signature. This is partly because the speed ratio between the rotational speed of the delivery fly 3 and the transfer speed of the conveyor C is the same as that in the straight run, the overlap pitch P becomes equal to that in the straight run, and partly because the conditions for forming the feathered overlap pitch P are the same as those in the straight run. The signature train Sa on the transfer surface of the conveyor C is transferred to the outside of the folding machine F by the conveyor C, and handled by a device on the downstream side, such as a grab transfer device for sequentially transferring the signatures S1, S2 and S3 one by one.

As described above, the present invention, which makes the operating speed of the delivery fly in the collect run half of the operating speed of the delivery fly in the straight run, as described above with reference to an embodiment, and makes the speed ratio between the operating speed of the delivery fly and the operating speed of the conveyor in the collect run the same as the speed ratio between the operating speed of the delivery fly and the operating speed of the conveyor in the straight run in making the feathered overlap pitch of signatures in the collect run the same as the feathered overlap pitch of signatures in the straight run, can eliminate a large amount of deviation in the feathered overlap pitch of signatures since a preceding signature is kept from being shifted to a great extent, together with a succeeding signature even when the succeeding signature moving at the operating speed of the delivery fly is placed on the conveyor in an unrestricted state and caused to move while in contact with the preceding signature moving at the operating speed of the conveyor. Thus, troubles in handling signatures by the downstream handling means due to a large amount of offset in the feathered overlap pitch of signatures can be prevented.

What is claimed is:

1. A delivery apparatus for folding machines having a folding apparatus and a delivery apparatus, the improvement comprising a delivery fly for receiving signatures folded by the folding apparatus, a conveyor operating at a predetermined speed ratio with respect to a delivery fly for receiving signatures from the delivery fly, a gear drive provided between the folding apparatus and the delivery fly and having a plurality of gear ratios for transmitting power to the delivery fly, changeover means capable of selectively changing over the gear ratios of the gear drive;

so that the operating speed of the delivery fly can be set to a plurality of speed steps with respect to the operating speed of the folding apparatus.

2. A delivery apparatus for folding machines as set forth in claim 1 wherein the folding apparatus comprises a cutting cylinder, a folding cylinder, and two folding rollers provided facing each other; the cutting cylinder having a plurality of cutting blades provided at equal intervals on the outer circumferential surface of the cutting cylinder, and the folding cylinder comprises a plurality of blade rests provided at equal intervals on the outer circumferential surface of the folding cylinder, a plurality of pins provided on the upstream side in the rotational direction of the folding cylinder in the vicinity of the blade rests in such a manner as to be retractable, and a plurality of tucker blades mounted on a tucker-blade supporting member provided coaxially on the cylinder shaft of the folding cylinder in such a manner that the tucker blades can be caused to protrude from the outer circumferential surface of the folding cylinder and inserted in between the two folding rollers.

3. A delivery apparatus for folding machines as set forth in claim 2 wherein the folding apparatus is such that the pins on the upstream side in the rotational direction in the vicinity of the blade rests of the folding cylinder pierce areas on the upstream side in the vicinity of the cutting position of longitudinally folded paper webs and hold areas in the vicinity of the cutting position of the longitudinally folded paper web on the outer circumferential surface of the folding cylinder before the longitudinally folded paper webs are cut by the cutting blades of the cutting cylinder and the blade rests of the folding cylinder.

4. A delivery apparatus for folding machines as set forth in claim 2 wherein the folding apparatus is such that the ratio of the circumferential length of the cutting cylinder and the folding cylinder is 2 to 3, the cutting cylinder has two cutting blades, the folding cylinder has three blade rests, three pins and two tucker blades, and the tucker-blade support member for supporting the two tucker blades at both ends thereof makes a ½ rotation at every ⅓ rotation of the folding cylinder.

5. A delivery apparatus for folding machines as set forth in claim 4 wherein the folding apparatus is such that the pins retract into the folding cylinder at every one rotation at a position ⅓ ahead in the rotational direction of the folding cylinder from the position where the cutting cylinder and the folding cylinder come very close to and face each other to sequentially release the cut-length sheets held by the pins, the tucker blades are caused to protrude from the outer circumferential surface of the folding cylinder simultaneously with the sequential release of the cut-length sheets by the pins and sequentially insert the intermediate parts of the cut-length sheets in between the two folding rollers provided in parallel in the vicinity of the downstream side of the folding cylinder, and the two folding rollers nip the intermediate parts of the cut-length sheets inserted in between the two folding rollers to form creases and release as signatures the cut-length sheets, with the creases leading the way, towards the delivery fly provided on the downstream side of the two folding rollers.

6. A delivery apparatus for folding machines as set forth in claim 1 wherein the gear drive has two gear ratios for the straight run for sequentially folding in the folding apparatus cut-length sheets obtained by cutting a paper web into a predetermined length and for the collect run for overlapping two cut-length sheets in the folding apparatus and then folding the overlapped two cut-length sheets.

7. A delivery apparatus for folding machines as set forth in claim 1 wherein the changeover means is provided rotatably with respect to the shaft of the delivery fly, and comprises two gears each having clutch tooth on a side surface thereof, and a double-faced tooth clutch, with both side surfaces thereof having clutch teeth each in mesh with the clutch tooth on each of the gears; the double-faced tooth clutch being restricted in the rotational direction with respect to the delivery fly shaft provided via a sliding key and axially movable.

8. A delivery apparatus for folding machines as set forth in claim 7 wherein the double-faced tooth clutch can be changed over via a pneumatic cylinder.

9. A delivery apparatus for folding machines as set forth in claim 1 wherein the discharge conveyor is driven by power transmitted by a delivery fly sprocket provided on the delivery fly shaft, a conveyor sprocket provided on the rotational shaft of the discharge conveyor, and an endless chain stretched over the delivery fly sprocket and the conveyor sprocket, so that the discharge conveyor is caused to rotate at a predetermined speed ratio with respect to the delivery fly.

10. A delivery apparatus for folding machines as set forth in claim 1 wherein the delivery fly has a plurality of small-diameter discs having a plurality of blades extending almost tangentially at equal intervals of the outer circumferential surface of the delivery fly; the small-diameter discs being provided on the delivery fly shaft, with the phases in the circumferential direction of the blades matched with each other.

* * * * *